United States Patent [19]

Tibbs

[11] Patent Number: 4,491,293

[45] Date of Patent: Jan. 1, 1985

[54] CAN HOLDER

[76] Inventor: Lilburn E. Tibbs, 3511 E. Rialto Ave., Fresno, Calif. 93726

[21] Appl. No.: 419,905

[22] Filed: Sep. 20, 1982

[51] Int. Cl.[3] ..... E06C 7/14

[52] U.S. Cl. ..... 248/211; 248/313

[58] Field of Search ..... 248/211, 312.2, 313, 248/311.2; 220/85 R, 85 H

[56] References Cited

U.S. PATENT DOCUMENTS

| | | | |
|---|---|---|---|
| 2,519,732 | 8/1950 | Bartolat | 248/211 |
| 2,522,658 | 9/1950 | Williams | 248/211 |
| 2,681,785 | 6/1954 | Jenny | 248/311.2 X |
| 3,094,304 | 6/1963 | Linder | 248/211 |
| 3,163,389 | 12/1964 | Thornburgh | 248/211 |
| 3,317,232 | 5/1967 | McFaul | D7/70 X |
| 3,503,644 | 3/1970 | Johnson | D7/70 X |
| 3,814,364 | 6/1974 | Gargaro | 248/311.2 X |

*Primary Examiner*—J. Franklin Foss

*Attorney, Agent, or Firm*—Worrel & Worrel

[57] ABSTRACT

A can holder for use with a can which includes a container having an open end and a base end and includes a bail pivotally movable at the open end, the holder having a clamp which has a pair of hooks movable toward and from each other individually to engage the container ends, a resilient element urging the hooks into such engagement, an element engagable manually to release the hooks from such engagement, and elements for adjusting the distance between the hooks for engagement of containers of different lengths between such ends; the holder having an elongated handle which has one end pivotally mounted on the clamp for movement of its other end toward and from the bail; and the holder having a hook mounted on such other end to engage the bail so that the holder and the can can be lifted by grasping the handle or suspended by an S-hook engaging the handle, the length of the handle being selectively variable to vary the angular relation of the bail to the container and to vary the angular relation of the container to the horizontal when the container is lifted or suspended.

7 Claims, 8 Drawing Figures

CAN HOLDER

BACKGROUND OF THE INVENTION

1. Field of the Invention

The present invention relates to a can holder, and more specifically to such a holder for mounting on an opened container to position the container for convenient access while applying paint or the like from the container, the holder providing a manually graspable handle as well as facility for supporting the can from a ladder or the like.

2. Description of the Prior Art

When brush painting from an opened paint container, the container must be supported for removal of paint therefrom by insertion of a brush or the like into the usual opening in the container. The container may be supported manually, either by directly grasping the container itself or by grasping a bail provided with the container. The container may also be supported by hanging it from a ladder rung or the like, as by an S-hook oppositely engaging the rung and the bail. When the container is hung from the bail, the opening is conventionally beneath the bail so that the bail impedes access to the opening and to the paint within the container. When the container is grasped directly by the hand this difficulty is avoided. However, it is tiring to grasp a container directly for an extended period. In any event, it is difficult, if not impossible, manually to grasp securely a container of substantial size, especially when the container is nearly full and relatively heavy. As the level of paint in a container decreases during painting, it becomes necessary to tilt the container to provide a sufficient depth of paint for effective insertion of a brush or the like. With the container hung by a bail, the container hangs in an upright position and must then either be tilted for each brush insertion or continually grasped in a tilted position, either procedure being tiring and inconvenient. If the container is grasped directly to support it in a tilted position, the attitude of the hand is often awkward, increasing the fatigue. The most desirable angle to tilt a paint container, either to avoid the bail while inserting a brush or to increase the depth of paint, varies as the container is emptied of paint, with the dimensions of the container, and whether the container is grasped directly or is suspended from a bail. To be fully effective, a can holder, for use with a paint container should, therefore, provide for convenient and selective variation of such angle.

PRIOR ART STATEMENT

In conformance with 37 C.F.R. §1.97 and §1.98, the applicant states that he is not aware of any prior art which is relevant to the patentability of the subject invention.

SUMMARY OF THE INVENTION

It is an object of the present invention to provide an improved can holder for use with an opened paint container or the like to support the container in a convenient attitude for painting therefrom.

Another object is to provide such a holder for use when such a container is grasped by the hand or when the container is suspended by a bail.

Another object is to provide such a holder wherein the angle of the container relative to the vertical is conveniently adjustable whether the can is grasped manually or is suspended by a bail.

Another object is to provide such a can holder which positions a bail mounted on the container so that the bail does not impede access thereto.

Another object is to provide such a holder adapted for mounting on containers of various sizes.

Another object is to provide such a holder which is easily mounted on and detached from a container.

A further object is to provide a can holder which has the above and other objects and advantages and which is economical, durable, and fully effective in performing its intended functions.

DESCRIPTION OF THE PREFERRED EMBODIMENT

Figure 2:
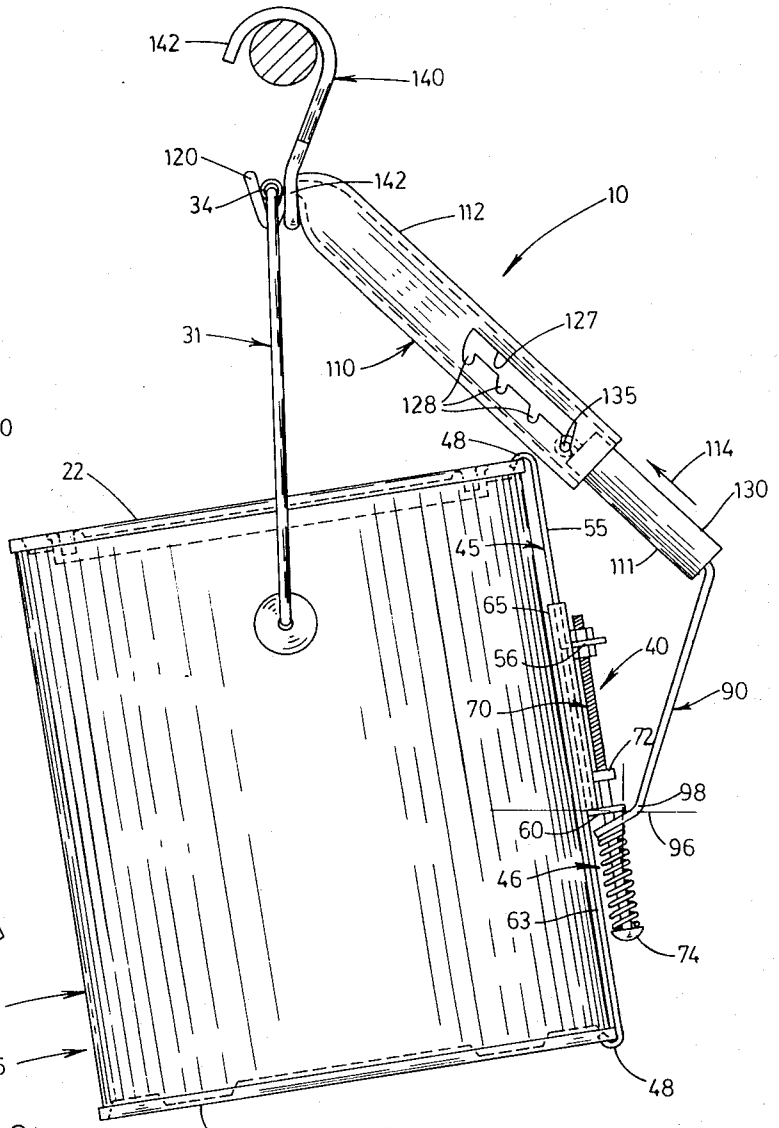
FIG. 2 is an elevation similar to FIG. 1, with the holder being in an alternate configuration for suspension from a ladder rung with the container at an alternate angle.
Figure 1:
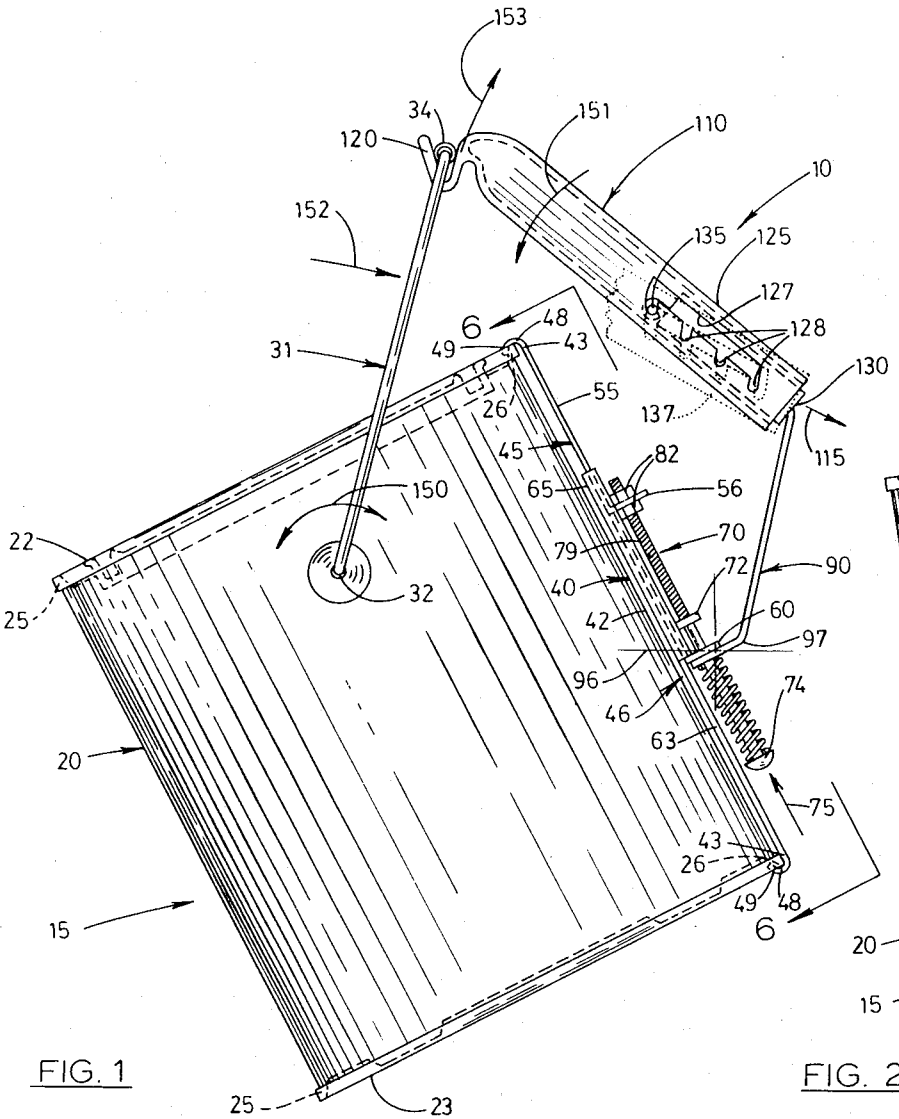
FIG. 1 is a side elevation of a can holder embodying the principles of the subject invention together with a representative can having a container of a predetermined size. The holder is depicted in a first configuration for mounting on the container and for holding it at a predetermined angle when the holder is grasped manually, a handle of the holder being fragmentarily represented by dot-dash lines in an alternate position.
Figure 4:
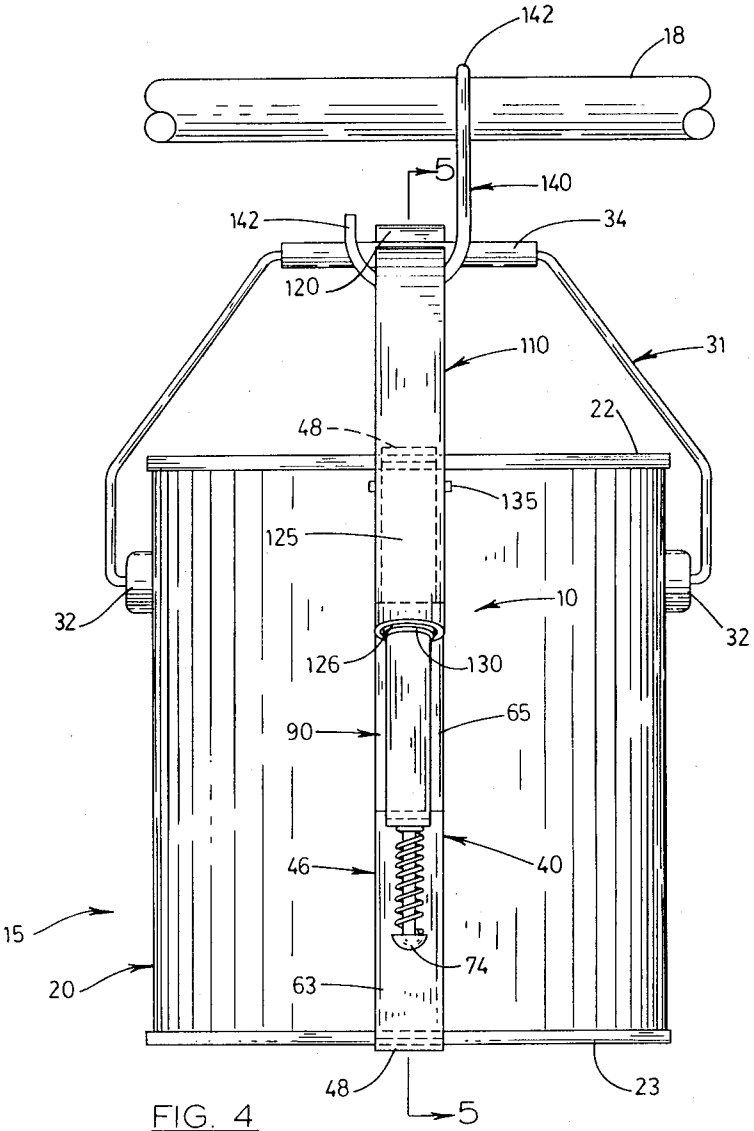
FIG. 4 is an elevation of the holder and a can taken from a position to the right of FIG. 2.
Figure 3:
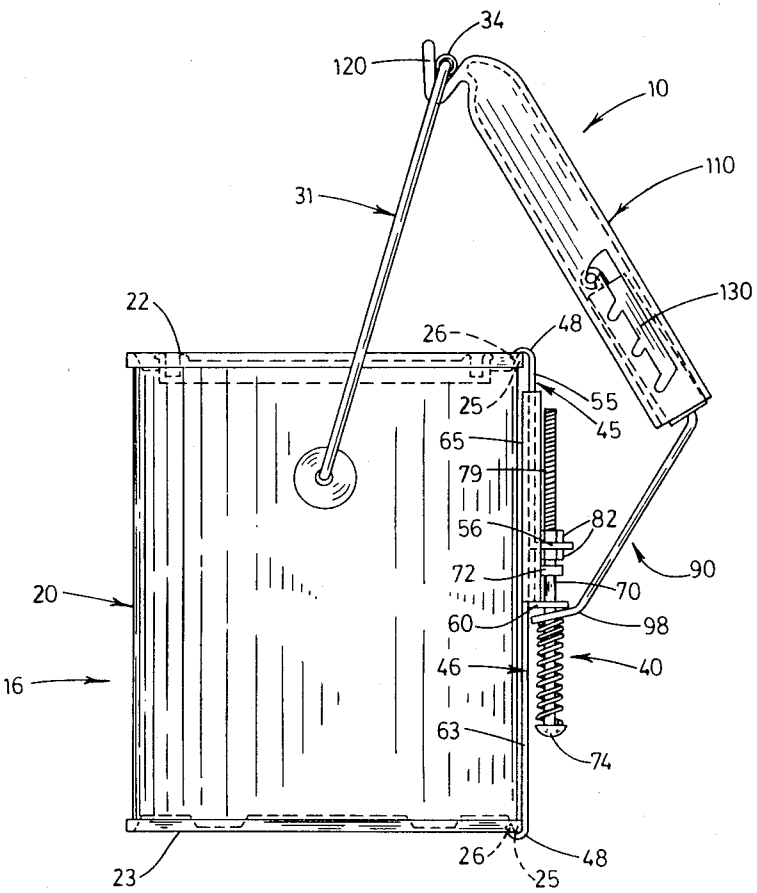
FIG. 3 is an elevation similar to FIG. 1 with the holder mounted on a container of an alternate size and in a configuration for manual grasping.

Referring with greater particularity to the drawings, in FIGS. 1 through 5 is shown a can holder 10 embodying the principles of the present invention. The holder is depicted in FIGS. 1, 2 and 4 mounted on a paint can 15 of relatively large size and is depicted in FIG. 3 mounted on a paint can 16 which is relatively smaller. The cans are of well-known construction. In FIGS. 2 and 4, the holder and can are depicted as being suspended from any suitable support object 18, typified as a rung of a ladder or the like.

Except for their different dimensions, the cans 15 and 16 are substantially identical, each having a cylindrical container 20 of a predetermined length and diameter. The container has an open end 22 and an opposite base end 23 spaced therefrom a distance substantially equal to such length. The open end has a central opening for access to paint within the container. Each end of the container bears a peripherally disposed, circumscribing ridge 25. Each ridge bears an annular surface 26. This surface is disposed toward the center of the container and extends axially of it in circumscribing relation to the corresponding container end. The can usually has a bail 31 which is generally U-shaped. The bail is pivotally mounted at its opposite ends to the container at points which are indicated by the numeral 32 and are disposed diametrically oppositely of the container and toward its open end. Centrally, the bail has a tubular grip 34. The dimensions and proportions of the bail are such that, by pivoting the bail about the points, it is movable to a position in which the grip is disposed in spaced relation to the open container end and is spaced oppositely of the base end, the bail being depicted in different such positions in FIGS. 1 through 3.

Figure 6:
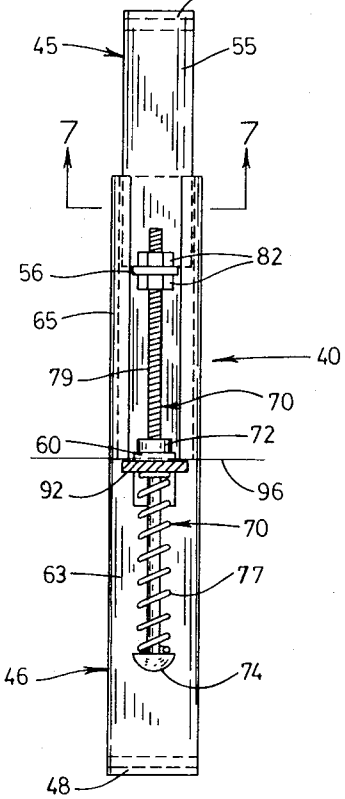
FIG. 6 is a fragmentary view of the holder taken from the position of line 6—6 of FIG. 1 and at the scale of FIG. 5.
Figure 5:
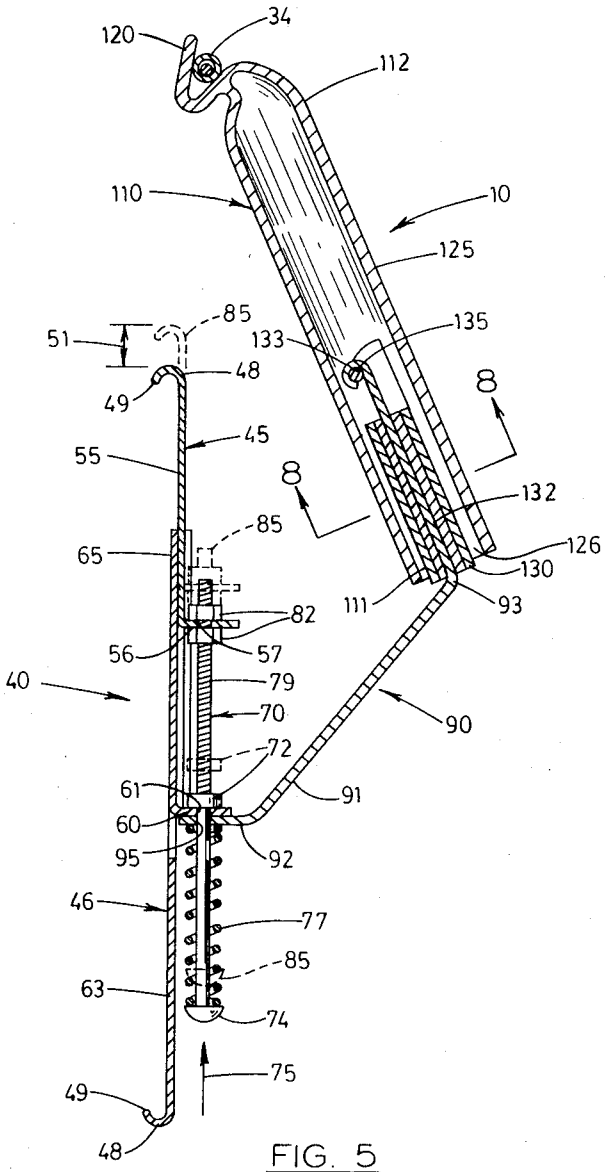
FIG. 5 is a vertical section of the holder taken from the position of line 5—5 of FIG. 4 and at an enlarged scale, alternate positions of various elements being represented in dash lines.

The holder 10 includes a clamp 40, best shown in FIGS. 1, 5 and 6. The clamp has an elongated member 42 which has a pair of opposite ends 43. When the holder is in use, this member extends peripherally along a container 20 between the open end 22 and the base end 23. The member has a first slide 45 and a second slide 46. Each slide extends centrally of the member from a corresponding one of such opposite ends. The slides are elongated in a direction along the member and overlap centrally of it. When the holder is in use, the first slide is disposed toward the open end of the container and the second slide is disposed toward the base end thereof so that the opposite ends of the elongated member are spaced substantially the predetermined length of the container. Each slide has a clamping hook 48 fixedly mounted thereon at the corresponding end of the elongated member. The clamp thus has a pair of the clamping hooks which are spaced approximately such predetermined length. These hooks open toward each other and are disposed so as to extend from the slides over the corresponding one of the ridges 25. Each hook has a lip 49 spaced from the corresponding slide substantially the thickness of the ridge, this lip extending along the slide toward the other hook approximately the distance the ridge extends axially of the container. Interiorly, each hook conforms to such ridge with the lip conforming to the annular surface 26 of the ridge. As a result, movement of each hook toward the corresponding one of the container ends, 22 or 23, serves to engage the hook with the ridge at such end. It is evident that movement of the hook away from the container end a distance greater than the length of the lip disengages the hook from each annular surface, this distance thus being a predetermined releasing distance which is indicated by the numeral 51 in FIG. 5. It is evident from FIGS. 2 and 3 that the releasing distance is substantially less than the difference between the respective lengths of the container of the larger can 15 and of the container of the smaller can 16.

Figure 7:
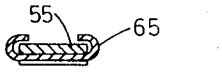
FIG. 7 is a fragmentary section taken from the position of line 7—7 of FIG. 6.

Referring in greater detail to the first slide 45, as best shown in FIGS. 5, 6, and 7, it is seen that this slide is generally L-shaped, having an elongated plate 55 extended from the corresponding one of the hooks 48 toward the other such hook and having a planar tab 56 extended normally from such plate and transversely thereof. The tab extends oppositely of a container 20 from the plate when the holder 10 is in use. As best seen in FIG. 6, the tab is narrower than the plate in a direction transversely thereof and is transversely centered on the plate. The tab has a bore 57 spaced from the plate and extended through the tab in a direction longitudinally of the plate. Preferably, the plate, the tab, and the corresponding hook are unitarily constructed in any suitable manner, such as being bent from sheet material.

The second slide 46 has a tab 60 disposed centrally along it and extended normally and transversely of it. This tab has a bore 61 extended through it in alignment with the bore 57 in the tab 56 of the first slide 45. The second slide has a plate 63 which extends from its tab 60 to the corresponding one of the clamping hooks 48 and is fixedly connected to such hook. The second slide has an elongated guide 65 which extends from the tab thereof oppositely of the plate thereof. The guide has a planar portion, which is disposed between the plate 55 and the container 20 when the holder 10 is in use. The guide has a pair of opposite lips which extend over such plate in transversely opposing relation thereto and retain the slides together, the lips being spaced to accommodate between them the tab 56 of the first slide. The guide is thus of channel-like cross section adapting it to receive the plate 55 of the first slide in slidably fitted relation for relative movement of the slides in a direction between the hooks. It is evident that the clamping hooks are mounted on the elongated member 42 for movement toward and from each other and that the slides serve to mount these hooks on each other for such movement. The length of the guide is such that such movement of the hooks is substantially greater than the difference between the predetermined lengths of the containers 20 of cans, such as the cans 15 and 16, with which the holder is to be used. The second slide and the corresponding clamping hook are unitarily constructed in a manner similar to the first slide and the other such hook.

The clamp 40 has an elongated cylindrical rod 70 extended axially through the bores 57 and 61 and slidably fitted therein. A stop collar 72 is fixedly mounted on the rod centrally longitudinally thereof. The collar is adjacent to the tab 60 of the second slide 46 and is disposed to engage the side of this tab toward the first slide 45. The rod is provided with a button 74 fixed to it at its end opposite the first slide. The button is disposed between such tab and the one of the clamping hooks 48 mounted on the second slide. The button is thus disposed for manual engagement to urge the rod in a direction indicated by the arrow 75 in FIGS. 1 and 5, this direction being from the base end 23 of a container 20 toward the open end 22 thereof when the holder 10 is in use. A helical compression spring 77 extends in circumscribing relation to the rod between the button and such tab and bears oppositely thereagainst. The spring thus resiliently urges the rod to move in a direction opposite the direction 75 until the stop collar engages the tab. The rod, the button, and the spring are then in their respective positions depicted in solid lines in FIG. 5 relative to the second slide. The rod has a portion 79 which is externally screw-threaded and which extends from the collar along the guide 65 nearly to the end of the guide remote from the tab 60. The screw-threaded portion is thus substantially longer than the difference in the lengths of the containers 20 of the cans 15 and 16. Such portions extends through the bore 57 in the tab 56 and bears a pair of nuts 82 disposed oppositely of this tab. The nuts are screw-threadably engaged with such portion and are tightened oppositely against this tab when the holder is in use so that the first slide and the rod move together. As a result, the spring urges the clamping hooks toward each other, and manually pressing the button in the direction 75 serves to move the clamping hooks the releasing distance 51 away from each other against the urging of the spring. When the hooks have moved this distance, as shown in FIG. 5, the rod, the first slide, and the one of the clamping hooks mounted thereon are disposed relative to the second slide in positions indicated by the numeral 85 and depicted in dash lines.

The holder 10 has a strut 90, best shown in FIGS. 1, 2, and 5. The strut has an elongated central portion 91 and has opposite end portions 92 and 93 disposed, respectively, at the tab 60 and remotely therefrom. The strut is planar, typically being bent from sheet material, so that its end portions are each disposed at an obtuse angle to its central portion. The end portion at such tab is provided with a bore 95 through which the rod 70 extends. This end portion is disposed between this tab and the corresponding end of the spring 77 and is oppositely engaged thereby. As a result, the spring urges the strut to pivot about its line of engagement with the tab 60 toward a position 97, shown in FIGS. 1, 4, 5, and 6, in which the tab and the strut end portion 92 are flatly engaged. This line thus defines an axis 96 extended transversely of the clamping hooks 48 and shown in FIGS. 1, 2, and 6. The strut is pivotable about this axis against the urging of the spring to a position 98, shown in FIGS. 2 and 3, in which the strut end portion 92 is disposed more closely to the clamp 40 and to a container 20 engaged thereby than when the strut is in its position 97. It is apparent that the spring urges the strut to pivot about such axis in a direction away from the clamp.

The holder 10 has a manually graspable handle 110 which is mounted on the strut 90 for pivotal movement therewith about the axis 96 in relation to the clamp 40. The handle is mounted on the strut so that the handle is disposed in spaced relation to the clamp and is disposed oppositely thereof from a container 20 engaged at its surfaces 26 by the clamping hooks 48. The handle is thus mounted by the strut on the elongated member 42 in spaced relation thereto. It is evident that the spring 77 urges the handle to pivot with the strut away from the clamp about such axis. The handle is elongated, having a first end portion 111 and an opposite second end portion 112. These end portions bear corresponding opposite ends of the handle, these opposite ends thus being disposed in spaced relation. The handle end portions are telescopically connected for selective movement toward each other, as indicated by the arrow 114 in FIG. 2, and from each other, as indicated by the arrow 115 in FIG. 1, in a direction between the opposite ends of the handle, thereby selectively varying the distance therebetween. The end portion 93 of the strut is unitarily constructed with the first end portion of the handle and extends from the corresponding handle end so that the strut and the clamp are mounted on such handle portion. The strut and the clamp thus serve detachably to connect the handle to a container 20 with the handle disposed in spaced relation thereto. It is evident that the strut then extends between the clamp and such end of the handle.

The holder 10 has a bail hook 120, best shown in FIGS. 1 and 5, mounted on the second portion 112 of the handle 110 at the corresponding handle end for detachably engaging the grip 34 of the bail 31 in lifting relation when the bail is in a position similar to those depicted in FIGS. 1, 2, and 3. The bail hook extends from the handle oppositely of the strut 90 and is mounted on the handle so that, when the holder is in use, the hook is disposed between the container 20 and the bail, as is evident from FIG. 1. The hook is configured to open in a direction toward the bail when the holder is in use, and the hook is thus disposed to engage the grip when the handle and the strut are pivoted about the axis 96 in a direction away from the clamp 40 and the container.

Figure 8:
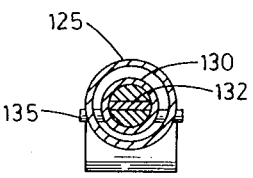
FIG. 8 is a fragmentary section taken from the position of line 8—8 of FIG. 5.

Referring in greater detail to the handle 110 and the bail hook 120, as best shown in FIGS. 1, 5 and 8, it is seen that this hook is unitarily constructed with the second handle portion 112. The bail hook and this handle portion are constructed from an elongated cylindrical tube 125 having a circular opening 126 at the end opposite the hook, the tube being flattened and bent at the other end to provide the hook. The tube is provided with two systems of slots 127 and 128 opening through it adjacent to such opening. The slot systems are disposed oppositely of the tube along a diameter thereof which is parallel to the grip 34 when the grip is engaged by the hook. Each slot system includes an elongated slot 127 which extends longitudinally of the handle and includes a plurality, typically four, of diagonal slots 128 which are spaced along the longitudinal slot and extend therefrom diagonally of the longitudinal slot in a direction toward the clamp 40 and the opening 126.

Referring in greater detail to the handle 110 and strut 90, as best shown in FIGS. 2, 4, 5, and 8, it is seen that the first handle portion 111 is unitarily constructed with the strut. The first portion has a cylindrical plunger 130 which is mounted on the portion 93 of the strut. The plunger is aligned axially with the tube 125 and is loosely and slidably fitted in this tube for axial motion therealong. As best shown in FIG. 5, the length of the plunger is approximately equal to the distance between the opening 126 and the diagonal slots 28 which are spaced farthest from this opening. The first handle portion includes a tongue 132 which is an extension of the strut centrally through the plunger and which terminates in an eye 133 disposed outwardly of the plunger and extended between corresponding opposed portions of the slots 127 and 128. The first handle portion has a pin 135 extended through the eye and such opposed slot portions, the pin being fixedly connected to the eye in any suitable manner. It is evident that the first handle porton is adapted for movement along the handle in relation to the second handle portion 112 so that the position of the bail hook 120 in relation to the first portion can be varied between such position shown in FIG. 1 and that shown in FIG. 2. When the pin is received in an opposed pair of the diagonal slots, as shown in solid lines in FIGS. 1 and 2, the pin secures the handle portion at a selected relative position along such movement corresponding to the such opposed pair of slots. By moving the tube 125 relative to the pin to a position 137, which is fragmentarily represented in dot lines in FIG. 1, the pin is disengaged from such pair of slots releasing the handle portions for such movement to vary the spacing of the bail hook from the first handle portion.

The holder 10 has an S-hook 140, shown in FIGS. 2 and 4, having a pair of opposite end portions or U-shaped hooks 142 which are disposed individually in a pair of planes which are in right-angular relation. These portions are configured so as to engage detachably and individually the rung 18 and the second portion 112 of the handle 110 adjacent to the bail hook 120, thereby to suspend the holder and a can 15 or 16 from the rung.

OPERATION

The operation of the described embodiment of the subject invention is believed to be clearly apparent and is briefly described at this point. The holder 10 is first adjusted for use with a container 20 of a predetermined length, in a manner apparent from FIGS. 1, 3, and 5.

The holder is so adjusted by loosening the nuts 82 and then rotating the nuts to move them, together with the first slide 45 which slides in the guide 65 along the screw-threaded portion 79 of the rod 70, toward or from the one of the clamping hooks 48 mounted on the second slide 46. The nuts and first slide are so moved until the opposite ends 43 of the member 42 and the clamping hooks are spaced a selected distance approximately equal to the length of a can 15 or 16 with which the holder is to be used. The nuts are then tightened oppositely against the tab 60 to retain the first slide in a selected position relative to the second slide corresponding to such selected distance. It is evident that only the nuts, the first slide, and the one of the clamping hooks mounted thereon move in relation to the balance of the clamp as this adjustment is performed. During this adjustment the rod does not move in relation to the button 74 and the spring 77 and the rod, the button, and the spring do not move in relation to the second slide. As a result, the tension of the spring and the releasing distance 51 are not affected when the clamp is adjusted for engagement with containers of different lengths. Since the relative movement provided for such one of the clamping hooks in relation to the other thereof is substantially greater than the difference between such lengths the relative movement of the one hook in relation to the spring and the rod is also greater than such difference.

After the distance between the clamping hooks 48 is adjusted, as described in the preceding paragraph, the button 74 is pressed in the direction 75 to move the hooks farther apart a distance equal to the releasing distance 51 while the clamp 40 is positioned alongside the container 20 with the hooks disposed oppositely of the container ends 22 and 23 and over the corresponding ridges 25. The button is then released and the spring 77 urges the clamping hooks toward each other and individually into clamping engagement with the surfaces 26, so that the clamp securely mounts the holder 10 on the container. When it is desired to release the clamp from the container, the button is simply pressed toward the spring to compress it and to move the clamping hooks apart to disengage them from such surfaces.

After engaging the clamp 40 with a container 20, as just described, the bail hook 120 is next engaged with the grip 34 of the bail 31 in a manner which is evident from FIG. 1. The bail is first pivoted, as indicated by the arrows 150, to a position opposite of the open end 22 of the container from its base end 23. The bail hook 120 and the handle 110 are then pressed toward the container, as indicated by the arrow 151, and the bail pivoted, as indicated by the arrow 152, into a position in which the bail hook is aligned with the grip 34. The hook and handle are then released and are pivoted by the spring 77 away from the container, as indicated by the arrow 153, so that the hook is engaged with the grip. This engagement is subsequently maintained by the resilient action of the spring. It is evident that the strut 90 connects the handle to the container for movement of the hook toward and from the bail when the bail is in such position.

It is evident from FIGS. 1 and 2 that, when the bail hook 120 and the bail 31 are engaged, the bail has a predetermined angular relation to the container 30. This position is determined by the length of the handle 110 between the strut 90 and the bail hook, one such position being shown in FIG. 1 and another such position being shown in FIG. 2. Therefore, this angular position is selectively variable by positioning the pins 135 in different opposed pairs of the diagonal slots 128, thereby correspondingly varying the position of the bail when engaged by the bail hook. The angular position of the bail in relation to the container is selected so that convenient access to paint or the like within the container is provided through the open end 22 thereof when the container is supported from the handle 110 by engagement of the clamp 40 with the ridges 25 and by engagement of the bail with the bail hook 120. The handle is, in turn, supported either by grasping it directly with the hand, as may be envisioned from FIG. 1, or by suspending the handle from the S-hook 140, as shown in FIG. 2. When the container is supported in either such manner, the end portions 111 and 112 of the handle tend to move apart, thereby firmly engaging the pin 135 in the selected pair of diagonal slots 128 so that such selected angular position does not change inadvertently. To change the angular relation of the container to the horizontal, as when it is desired to obtain better access to paint at a lowered level within the container, the pin is repositioned in another such pair of slots to vary the distance between the ends of the handle and thus vary the pivotal position of the bail relative to the container and determine a desired such angular relation corresponding to such distance and position.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A can holder for use with a can having a container, which has an open end and an opposite base end, and having a bail pivotally mounted on the container movable to a position which is opposite of the base end and is in spaced relation to the open end, the holder comprising:

A. a handle having a first end and an opposite second end spaced therefrom,

B. means mounted on the first end for detachably connecting the handle to the container with the handle disposed in spaced relation thereto, C. means mounted on the second end for detachably engaging the bail in lifting relation when the bail is in such position comprising a hook which is disposed between the container and the bail and which opens toward the bail when the bail is in such position and wherein the connecting means connects the handle to the container for movement of the hook toward and from said position so that movement of the handle from the container engages the hook with the bail for support of the container by the handle, and wherein the bail is pivotally mounted on the container; wherein said connecting means comprises a clamp releasably attachable to the container and a strut extended between the clamp and such first end of the handle; and wherein the handle includes means for varying selectively the distance between said first end and said second end so that the position of the hook in relation to said first end and the position of the bail when engaged by the hook are correspondingly varied to determine the pivotal relation of the bail and the container.

2. The holder of claim 1 wherein the holder is for use in suspending the container from a support object and wherein the holder further comprises a suspension element having means for detachably engaging such object and having a hook configured to engage detachably the second portion of the handle so that the container is suspended from such object at an angular relation to the horizontal corresponding to such pivotal relation of the bail and the container determined by such selected distance between said first end of the handle and the second end thereof.

3. The holder of claim 1 further comprising a bail hook having opposite ends, one such end being configured to engage the handle and the other of such ends being engageable with a support object to suspend the bail hook, the holder and the can from said object.

4. A can holder for use with a can having a generally cylindrical container, which has a base end, an opposite open end spaced a predetermined length therefrom, and a pair of axially extended annular surfaces individually circumscribing said ends, and having a bail, which is mounted on the container for pivotal movement relative thereto and has a grip positionable by such pivotal movement oppositely of the open end from the base end in spaced relation to the open end, the holder comprising:

A. a clamp having a pair of opposing clamping hooks spaced approximately said predetermined length and conforming individually to said surfaces; means mounting one of the clamping hooks on the other thereof for movement toward and from such other hook; resilient means urging such one clamping hook toward such other clamping hook so as to engage said hooks individually with said surfaces when said hooks are disposed oppositely of said ends of the container; and manually engagable means for moving such one clamping hook from such other clamping hook against the urging of the resilient means to disengage the clamping hooks from said surfaces;

B. an elongated handle having a pair of opposite ends;

C. a strut extended between the clamp and one of the opposite ends of the handle, the strut mounting the handle on the clamp for pivotal movement about an axis extended transversely of the clamping hooks with the handle disposed in spaced relation to such hooks and disposed oppositely thereof from such a container having said surfaces thereof engaged with the clamping hooks;

D. a bail hook mounted on the other of the opposite ends of the handle, the bail hook being disposed so as to engage the grip when the handle pivots about such axis in a direction away from a container so engaged with the clamping hooks; and E. resilient means urging the strut to pivot together with the handle about such axis in said direction so that the bail hook is maintained in engagement with the grip.

5. The holder of claim 4 further comprising an S-hook having opposite end portions, one such portion being configured to engage the handle at said other of the opposite ends thereof and the other such portion being engagable with a support object to suspend the S-hook, the holder, and the can from said object.

6. The holder of claim 4 wherein the handle includes

A. a portion bearing said one end of the handle,

B. a portion bearing said other end of the handle,

C. means connecting said portions for movement of said ends toward and from each other to vary the length of the handle, and D. means for releasably securing said portions together at selected positions along said movement to determine the spacing of the bail hook from said one end of the handle and from the container, thereby to position the bail at a corresponding position along the pivotal movement thereof when the grip is engaged by the bail hook.

7. The holder of claim 4 wherein the holder is adapted for use with a variety of such containers in which said predetermined lengths are different for different such containers; wherein such manually engagable means moves the clamping hooks from each other a predetermined releasing distance substantially less than the difference between two such predetermined lengths; wherein the means mounting the clamping hooks for movement toward and from each other mounts the hooks for such movement a distance substantially greater than such difference; and wherein the clamp includes means for moving one of the clamping hooks a distance at least equal to such difference in relation to the other of said hooks and in relation to said resilient means and said manually engagable means so that the tension of said resilient means and the releasing distance are substantially constant when the clamp is engaged with containers having such different predetermined lengths.

* * * * *

UNITED STATES PATENT AND TRADEMARK OFFICE

CERTIFICATE OF CORRECTION

PATENT NO. : 4,491,293

DATED : January 1, 1985

INVENTOR(S) : Lilburn E. Tibbs

It is certified that error appears in the above-identified patent and that said Letters Patent is hereby corrected as shown below:

Column 4, line 56: delete "portions" and substitute ---portion---.

Column 6, line 30: delete "28" and substitute ---128---.

Signed and Sealed this

*Twenty-first* Day of *January 1986*

[SEAL]

*Attest:*

DONALD J. QUIGG

*Attesting Officer*

*Commissioner of Patents and Trademarks*